United States Patent [19]

Riley

[11] Patent Number: 5,033,332

[45] Date of Patent: Jul. 23, 1991

[54] METHOD AND APPARATUS FOR CONCENTRATING TRANSITION ELEMENTS FROM PARTICULATE SOURCES

[75] Inventor: Joseph L. Riley, Milwaukie, Oreg.

[73] Assignee: Riley Riffle Corp., Portland, Oreg.

[21] Appl. No.: 479,825

[22] Filed: Feb. 14, 1990

[51] Int. Cl.[5] ..... B07C 9/00

[52] U.S. Cl. ..... 266/249; 75/712; 209/655

[58] Field of Search ..... 75/712; 209/655; 266/249

[56] References Cited

U.S. PATENT DOCUMENTS 2,101,381 12/1937 Appleyard ..... 209/655

3,394,806 7/1968 Vaillette ..... 209/655

*Primary Examiner*—Peter D. Rosenberg

*Attorney, Agent, or Firm*—Olson & Olson

[57] ABSTRACT

Apparatus for concentrating gold-containing particulate material includes a housing containing an endless conveyor belt the upper stretch of which is inclined in the direction of its movement. An infeed hopper adjacent the upper end of the belt functions to deposit gold-containing particulate material on the upwardly moving upper stretch of the belt, and said stretch is inclined sufficiently to cause the particulate material to move downwardly over the upwardly moving upper stretch in a manner to effectuate classification of the particulate material by gravity separation into a minor fraction of valuable particles of smaller size and heavier specific gravity, including fine and microfine gold particles, and a major fraction of tailings particles of larger size and lighter specific gravity. A plurality of small pockets are spaced apart across the width and along the length of the conveyor belt and are configured to intercept the downwardly moving particulate material and to collect said minor fraction and move said fraction upward and over the upper end of the belt and then downward over the lower stretch of the belt where the pockets are upended and the collected minor fraction falls by gravity to a receiver bucket. The tailings fraction exits the lower end of the upper stretch of the conveyor belt. The particulate material may be deposited on the conveyor belt in a dry state, or it may be deposited as a water slurry.

26 Claims, 4 Drawing Sheets

METHOD AND APPARATUS FOR CONCENTRATING TRANSITION ELEMENTS FROM PARTICULATE SOURCES

BACKGROUND OF THE INVENTION

This invention relates to the recovery of transition elements, and more particularly to the recovery of gold including microfine gold from gold-containing ores and other particulate materials.

It is generally recognized that the placer mining of gold fails to recover a substantial portion of the fine and microfine gold content of the ore, which may constitute as much as 20% of the total gold content, since that form of gold is readily carried away either with the rapid flow of water or by floating on the less turbulent flow. Conventional placer operations concede this loss because they are capable of recovering only the conventional size particles.

Additionally, many gold deposits are located in dry areas where water is not available, and therefore the conventional recovery processes are not usable.

SUMMARY OF THE INVENTION

In its basic concept, the method and apparatus of this invention effectively recovers a substantial portion of the fine and microfine content of gold in ores and other gold-containing particulate materials by causing the particulate material to gravitate down an upwardly moving stretch of an endless inclined conveyor provided with a plurality of upwardly facing, laterally and longitudinally spaced pockets in which the heavier particles of gold as well as the fine and microfine gold become trapped with other smaller and heavier particles as the remaining particulates cascade down the conveyor. The trapped gold and other particles then are carried over the upper end of the conveyor and as the pockets are upended the concentrated contents of the pockets are discharged by gravity for collection and further processing for recovery of the gold content.

It is the principal objective of this invention to provide a method and apparatus for recovering transition elements, including gold in conventional particle size as well as in fine and microfine form, from ores and other particulate materials containing such elements.

Another objective of this invention is the provision of a method and apparatus of the class described which are operable in areas devoid of accessible water.

A general objective of this invention is to provide a method and apparatus of the class described which are operable to recover other transition elements in addition to fine and microfine gold.

A further objective of this invention is the provision of apparatus of the class described which includes an endless conveyor having an arrangement of pockets configured to effectuate the efficient concentration of particles of one or more transition elements including fine and microfine gold particles from ores and other particulate materials containing such particles.

A still further objective of this invention is to provide apparatus of the class described which includes means for adjusting the angle of inclination of the conveyor, the speed of movement of the conveyor and/or the rate of delivery of water to the conveyor, for varying the conditions of classification of various kinds of particulate material.

Another object of this invention is the provision of apparatus of the class described which is portable for transport to remote areas of use.

A further object of this invention is to provide apparatus of the class described which includes a self-contained recirculating supply of water.

A still further object of this invention is to provide apparatus of the class described which includes a source of heated air for assisting in the drying of particulate material as it flows down the upwardly moving upper stretch of the conveyor, to enhance the classification action.

The foregoing and other objects and advantages of this invention will appear from the following detailed description, taken in connection with the accompanying drawings of preferred embodiments.

DESCRIPTION OF THE PREFERRED EMBODIMENTS

Although the detailed description set forth hereinafter utilizes the concentration of gold-containing particulate material to explain the structure of the apparatus and the method performed thereby, this invention is effective in concentrating particulate material which includes any one or more of the elements of the first, second and third transition series in Groups 4b, 5b, 6b, 7b, 8 and 1b of the Periodic Table of the Elements, with the exception, of course, of Technetium.

These elements range in specific gravity from 4.51 $g/cm^3$ for titanium to 21.45 $g/cm_3$ for platinum, and the mineral sources for the elements range in specific gravity from about 4 $g/cm_3$ to about 10.5 $g/cm^3$. All of these elements and their mineral sources are characterized by specific gravities which are substantially greater than the usual rock sand, dirt and other debris, having an average specific gravity of about 2.6 $g/cm^3$, that is included in the mass of material excavated at the mine site. It is by virtue of this difference in specific gravity that the desired heavier material is capable of being separated from the undesired, lighter tailings matter by specific gravity classification.

Figure 1:
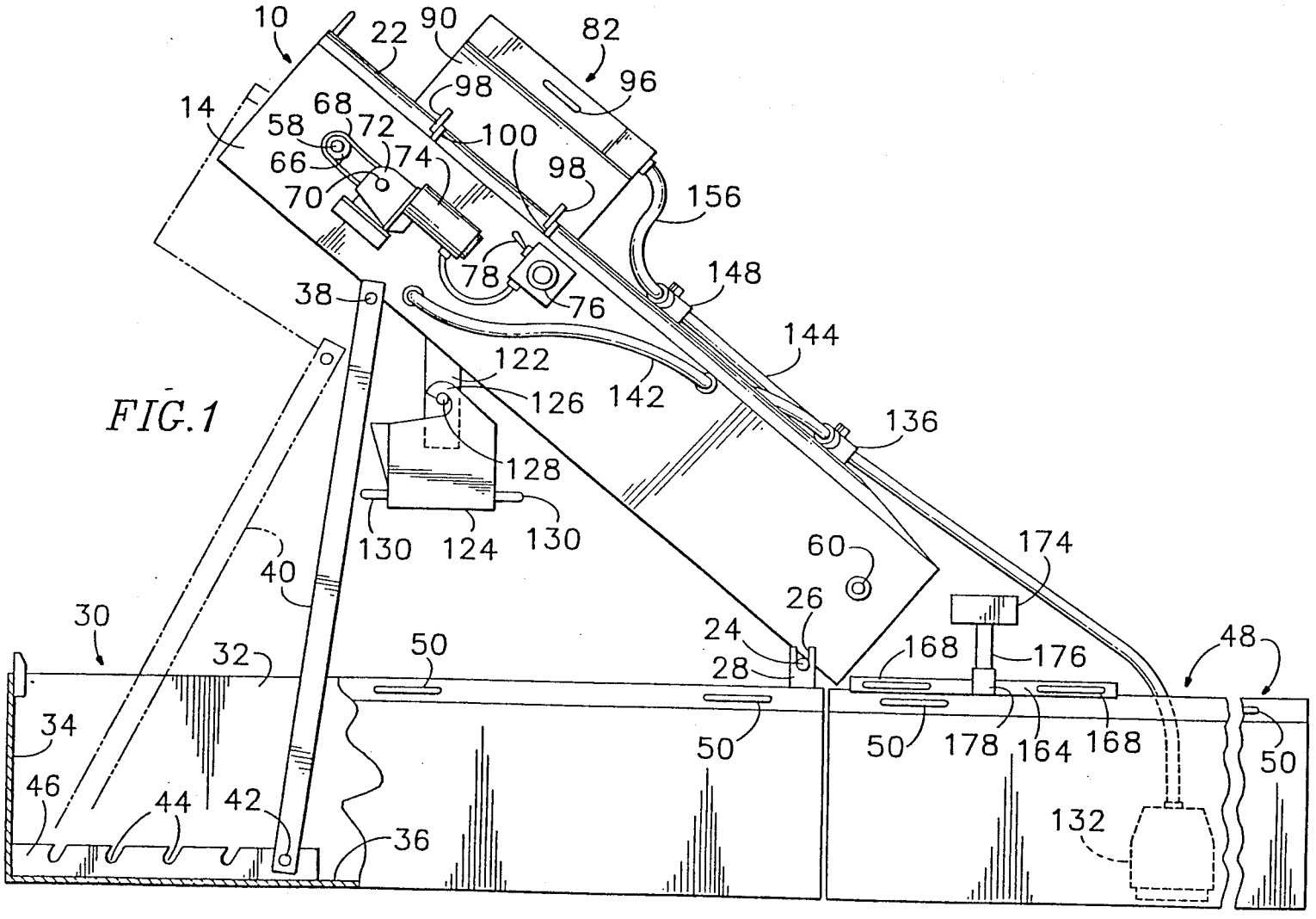
FIG. 1 is a foreshortened side elevation of apparatus embodying the features of this invention and employing the method of this invention for recovering transition elements and in particular gold including microfine gold from gold containing ores and other particulate material containing gold.
Figure 2:
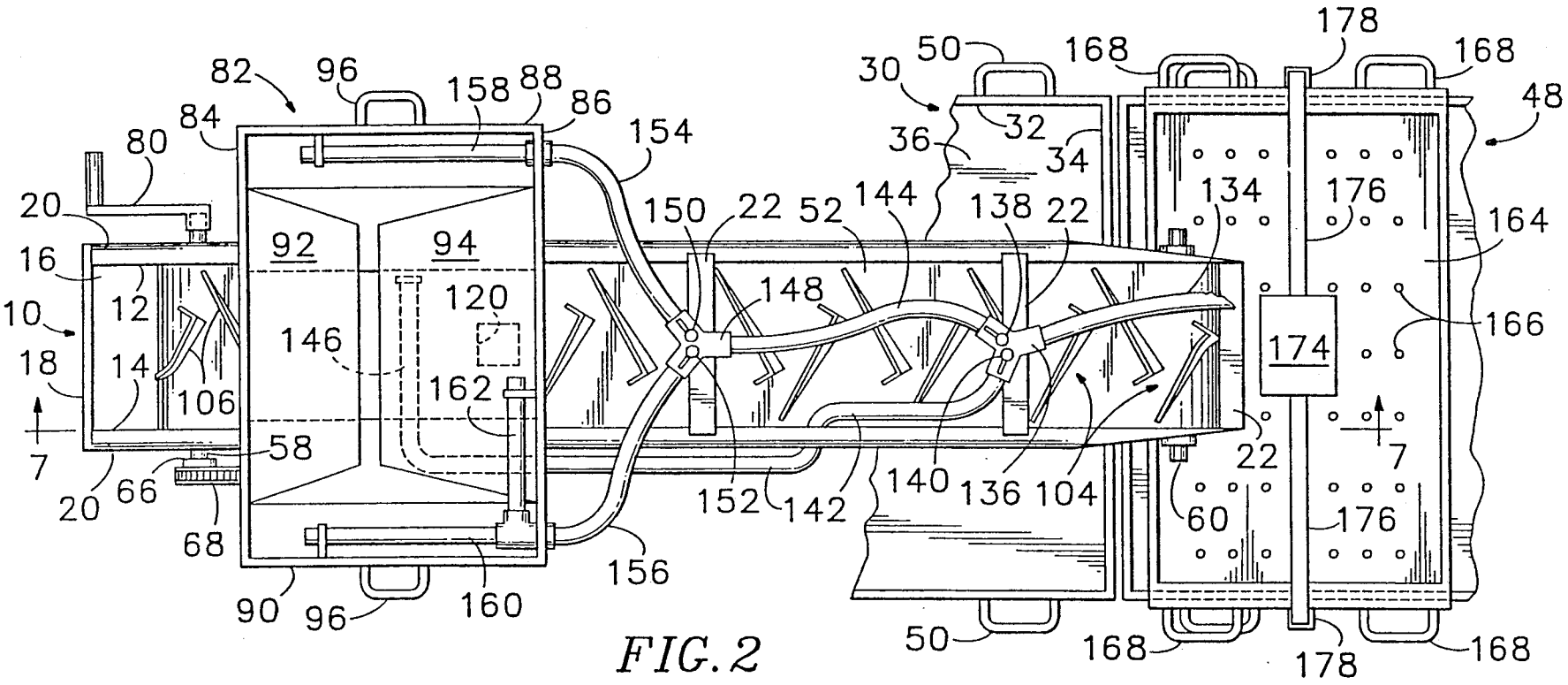
FIG. 2 is a plan view of the apparatus of FIG. 1.
Figure 7:
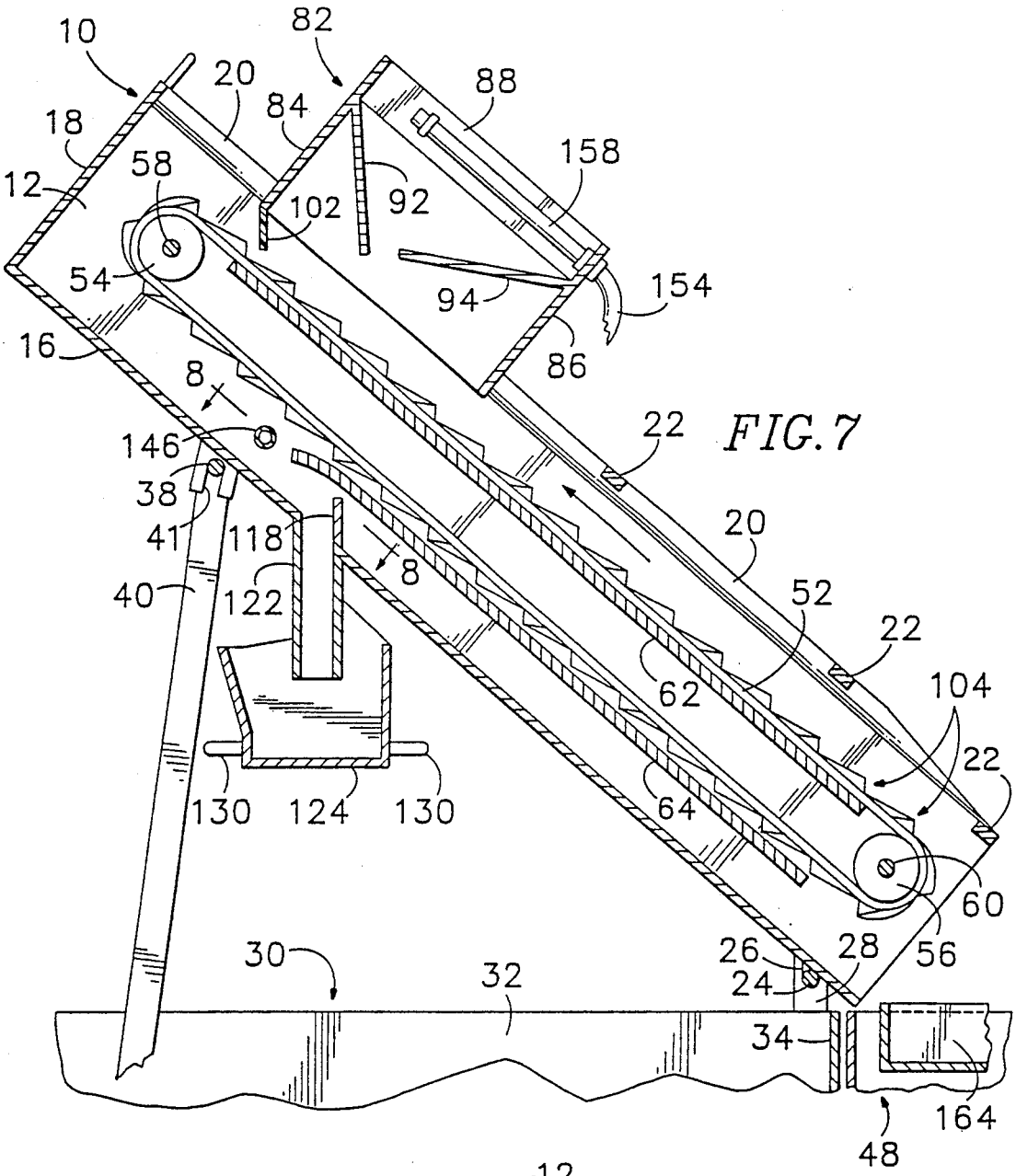
FIG. 7 is a fragmentary vertical section taken on line 7—7 in FIG. 2.
Figure 8:
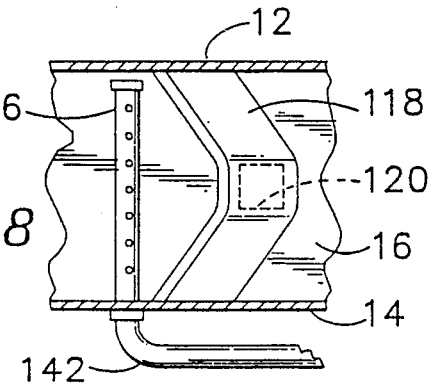
FIG. 8 is a fragmentary sectional view taken on line 8—8 in FIG. 7.

Referring first to the embodiment shown in FIGS. 1, 2 and 7, the apparatus includes a main elongated housing 10 formed of lateral side walls 12 and 14, bottom wall 16 and end wall 18. The upper ends of the side walls are reinforced by longitudinal flanges 20 and secured together at longitudinally spaced positions by transverse connecting straps 22.

As shown in FIG. 2, the housing is disposed in an inclined position, with the open end of the housing at the lower end and the closed end 18 at the upper end. A transverse shaft 24 at the lower end of the housing is supported removably in bearing notches 26 in a pair of laterally spaced brackets 28. The brackets are secured to and project upwardly from one end of a rectangular container 30 formed of side walls 32, end walls 34 and bottom wall 36.

A transverse shaft 38 connects together the upper ends of a pair of elongated braces 40. The shaft 38 is configured for removable reception in a pair of laterally spaced bearing notches 41 in brackets secured to the side walls 12 and 14 of the housing 10. The lower ends of the braces are connected by a transverse shaft 42. The shaft 42 is configured for removable reception selectively in any one of a plurality of longitudinally spaced pairs of notches 44 in a pair of laterally spaced brackets 46 projecting upwardly from the bottom wall 36 of the container 30. It is by this means that the degree of inclination of the housing may be varied between the limits afforded by the pairs of notches 44, as illustrated in FIG. 1.

In the embodiment illustrated, a companion container 48 of substantially the same size and shape as the container 30 is provided for disposition forwardly of container 30 to collect tailings from the concentration operation described hereinafter. The container 48 also serves as a cover to overlie the container 30 when the apparatus is disassembled for transport. For this purpose both containers are provided with a plurality of perimeter handles 50 by which to facilitate manual manipulation. In the storage position, all of the operating components of the apparatus are packaged within the confines of the containers.

Within the housing there is mounted a substantially imperforate elongated endless conveyor belt 52. The belt is supported on end rolls 54 and 56 which are mounted for rotation about the axes of shafts 58 and 60, respectively. The shafts extend through openings in the side walls 12 and 14 and are supported for rotation by bearings mounted on the side walls. Backing plates 62 and 64 slidably support the upper and lower stretches of the belt, respectively, between the rolls.

One outer end of upper shaft 58 mounts a drive sprocket 66 which engages drive chain 68. The drive chain also engages a sprocket on the output shaft 70 of a gear reduction unit 72. This unit is coupled to a variable speed electric drive motor 74. The drive motor is connected through a speed control potentiometer 76 and an on-off switch 78 to a source of electric potential (not shown). The source of electric potential usually is a portable electric generator driven by a gasoline engine. The drive motor functions to rotate the upper roll 54 counterclockwise in FIG. 7 and thus move the upper stretch of the conveyor belt 52 in the upwardly inclined direction indicated by the arrow.

In the event a source of electric potential is not available, a hand crank 80 is attachable to a squared end of the shaft 58 to afford manual operation of the apparatus.

Means is provided for delivering gold-containing ore or other particulate material containing gold to the conveyor belt 52. As illustrated, an infeed hopper 82 is formed of end walls 84 and 86 and side walls 88 and 90. Baffle plates 92 and 94 extend inwardly and downwardly from the end walls 84 and 86, respectively, to form a limited opening through which particulate material is metered to the conveyor belt 52.

The hopper side walls taper inwardly from the outer end of the hopper to a width less than the width between the side walls 12 and 14 of the conveyor housing. A pair of handles 96 on the side walls facilitate manipulation of the hopper between a storage position removed from the conveyor housing and an operative position supported removably on the conveyor housing. This operative position is established by the interengagement of lugs 98 on the hopper side walls 88 and 90 and cooperating lugs 100 on the conveyor housing side walls 12 and 14.

The infeed hopper is positioned on the conveyor hopper adjacent the upper end of the conveyor belt 52. Particulate material thus is deposited adjacent the upper end of the upwardly moving upper stretch of the conveyor belt. A wiper blade 102, preferably flexible, extends downwardly from the bottom edge of the hopper end wall 84 to limit the depth of particulate material that may pass upwardly to the upper end of the conveyor belt.

The conveyor belt is provided with a plurality of small particulate collecting pockets spaced apart along the length and width of the belt. The arrangement of pockets allows the particulate material to roll, bounce and otherwise move or be momentarily suspended over the belt to effect classification by specific gravity and thus to trap only the minor, valuable proportion of the smaller size and higher specific gravity particles that are separated out of the mass of particulates fed from the hopper to the conveyor belt.

In FIGS. 1–4, each of the pocket members 104 is formed of an elongated wall 106 that extends angularly across the belt in the downwardly inclined direction of the belt. The wall increases progressively in height in said downward direction. The elongated wall joins with a short wall 108 that extends further across the belt and forms with the elongated wall 106 an included angle of less than 180 degrees, preferably about 90 degrees. The short wall 108 decreases progressively in height from its juncture with the elongated wall 106.

The pocket 110 thus formed between the walls 106 and 108 is small in maximum width a (FIG. 3), representing but a fraction, e.g. not more than one-half and preferably no more than about one-fourth of the width of the belt. Thus, only the smaller size and heavier specific gravity particles are collected in the pocket. The inside of the pocket is rounded to facilitate release of particulate material collected therein.

The pocket members 104 are arranged along the length of the conveyor belt 52 with the elongated wall 106 of each succeeding pocket member extending in the opposite lateral direction downwardly across the belt. Each succeeding pocket thus is displaced laterally of the next preceding pocket, but in line with the elongated wall. Accordingly, the particulate material which flows over one of the pocket members is intercepted by the next succeeding upwardly moving pocket member, and so on, to effectuate the classification process.

Figure 6:
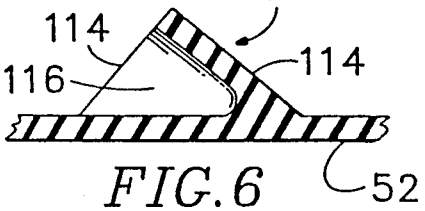
FIG. 6 is a fragmentary enlarged sectional view taken on line 6—6 in FIG. 5.
Figure 4:
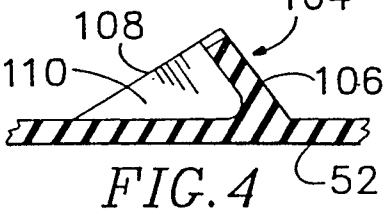
FIG. 4 is a fragmentary enlarged sectional view taken on line 4—4 in FIG. 3.
Figure 5:
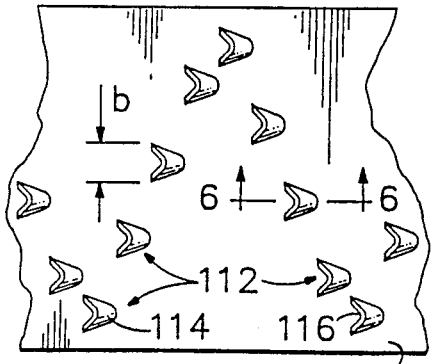
FIG. 5 is a fragmentary plan view, similar to FIG. 3, showing a modified form of particulate collecting pocket.

In FIGS. 5 and 6, a plurality of small pocket members 112 are spaced apart laterally on the conveyor belt in rows which extend in the downwardly inclined direction of the belt successively in opposite directions. Each pocket member is formed of a pair of short walls 114 of equal length forming between them an included angle of less than 180 degrees, as previously described. The walls thus form between them a small pocket 116 having a maximum width b (FIG. 5) but a small fraction, e.g. about one-tenth of the width of the belt.

In the arrangement illustrated in FIG. 5, the pocket members 112 in each succeeding row are displaced laterally a distance to be aligned longitudinally with the space between adjacent pocket members in the next preceding row. Thus, particulate material which passes through the space between adjacent pocket members in a preceding row is intercepted by pocket members in the next succeeding row.

Particulate material collected in the pockets 110 or 116 move with the latter upward and around the upper roll 54, whereupon the pockets are turned upside down. The concentrated particulate material thereupon falls by gravity from the pockets to the downwardly sloping bottom wall 16 of the conveyor housing. The downward movement of the particulates on the bottom wall 16 is intercepted by a diverter blade 118 which extends between the housing side walls 12 and 14 and projects upward from the bottom wall immediately downstream from an outlet opening 120 in the bottom wall. Particulate material thus is directed into the outlet opening.

Registering with the outlet opening 120 and extending downward therefrom is an outlet pipe 122 by which particulate material is delivered to a receiver bucket 124. The bucket is provided with a pair of hooks 126, shown to be fashioned from the opposite side walls of the bucket, arranged to engage a pair of shafts 128 projecting to opposite sides of the outlet pipe 122. The bucket thus may be hung under the outlet pipe in position to receive the particulates discharged from the pockets of the conveyor belt 52. A pair of handles 130 on the bucket facilitate its manipulation.

It is important to note, that in accordance with this invention, substantially all of the particulate material deposited upon the upwardly moving upper stretch of conveyor belt 52 is to be moved downward over the upwardly moving upper stretch of the conveyor. This is accomplished by adjusting the angle of inclination of the conveyor belt, by the position of the braces 40 in notches 44, and by adjusting the speed of movement of the belt, by speed control potentiometer 76.

As the particulate material flows downward over the upwardly moving upper stretch of the conveyor belt, it is subjected to an action, including momentary suspension, which results in the material being classified into a minor, valuable concentrated fraction of smaller size particles and particles of higher specific gravity, i.e. of about 4.5 and higher, which include the noble metals, and a major tailings fraction of dirt and other lower specific gravity particles which have no mineral value. Generally, the recovered concentrate fraction constitutes less than about 1 percent by weight of the particulate material delivered to the infeed hopper.

The classifying action results from the particulate material being caused to roll and bounce downward or otherwise be suspended momentarily over the upwardly moving upper stretch of the conveyor belt. As is well known, this action results in the smaller and heavier particles gravitating toward the bottom of the mass of particles. The great proportion of the particulate material, including some of the desired particles, moving downwardly over the upwardly moving upper stretch of the conveyor belt pass over and around many of the pockets before the major portion of the desired particles are collected in the pockets. The remaining undesired tailings fall from the lower end of the conveyor belt.

The particulates collected in the pockets 110 travel with the conveyor belt upwardly over the upper roll 54. The open side of the pockets thereupon face downwardly as the lower stretch of the belt moves in the downward direction. The contents of the pockets thus fall by gravity from the pockets and are collected in the receiver bucket 124.

The method and apparatus of this invention may be used to process particulate material either in a dry state or in a water slurry. The embodiment illustrated in FIGS. 1, 2, 7 and 8 accommodates processing in water slurry. For this purpose the containers 30 and 48 are filled to about one-half to two-thirds capacity with water, and a portable electrically driven water pump 132, typically of the sump type, is placed in one of the containers, such as container 30 in FIG. 1. The pump is connected to a suitable source of electric potential (not shown).

The outlet of the water pump is connected to one end of a length of hose 134 the opposite end of which is connected to one leg of a Y-fitting 136. The other two legs of the fitting are provided with control valves 138 and 140 and are connected to lengths of hose 142 and 144, respectively.

Hose 142 connects to a perforated pipe 146 which extends across the conveyor housing under the lower stretch of conveyor belt 52 just upstream from the outlet diverter blade 118. The perforated pipe provides water jets to impinge the belt and pockets and clean the particulates therefrom.

Hose 144 connects to one leg of a Y-fitting 148. The other two legs of the fitting are provided with control valves 150 and 152 and are connected to lengths of hose 154 and 156, respectively.

Hose 154 is connected to a perforated pipe 158 supported in the infeed hopper adjacent the upper end of side wall 88. The perforated pipe 158 directs jets of water into the hopper to wet the particulate material therein.

Hose 156 is connected to perforated pipe 160 supported in the infeed hopper adjacent the upper end of side wall 90 and also is connected to perforated pipe 162 supported in the hopper adjacent the upper end of end wall 86. These perforated pipes also direct jets of water into the hopper to wet the particulate material.

The amount and location of delivery of water to the hopper and pockets may be controlled by selective adjustment of the control valves, as will be understood.

Since the particulate material is carried downwardly over the upwardly moving upper stretch of the conveyor belt 52 as a water slurry, water exits the lower end of the conveyor belt with the tailings. Accordingly, a tailings receiver tray 164 is provided to overlie a portion of the container 48 to receive the tailings. A multiplicity of tiny openings 166 in the tray allows water to drain through into the container 48. Periodically, the tailings are removed from the tray by manipulation of the tray manually, by use of the handles 168.

It will also be apparent that water will be discharged from the pockets along with the concentrated particulates. The water collects in the receiver bucket 124 and overflows the latter into the container 30. Accordingly, the water pump 132 periodically will be transferred between containers 30 and 48, as will be understood.

In the operation of the apparatus illustrated in FIGS. 1, 2 and 7, a supply of water is filled into the containers 30 and 48 and the water pump 132 is placed in one of them. The electric motor 74 is energized to move the conveyor belt 52 in the direction of the arrow in FIG. 7. The water pump is activated and the water delivery control valves opened to deliver water to the perforated pipes 146, 158, 160 and 162. Particulate material then is delivered to the infeed hopper 82 from whence it is metered to the upper portion of the upwardly moving upper stretch of the conveyor belt.

The jets of water from the perforated pipes in the hopper assist in metering the particulate material to the upper end portion of the upwardly moving upper stretch of the conveyor belt. In addition, the mixture of water and particulate material form a slurry which flows downwardly over the upwardly moving upper stretch.

As the slurry cascades downward, the agitation of the water causes some of the particulates to roll along the belt and other particulates to be carried downward, suspended in the body of water. When the slurry impacts the elongated wall 106 of a pocket member 104, it is diverted laterally angularly along the wall. The speed of the slurry is increased substantially, creating more turbulence of the slurry. When the slurry impacts the short wall 108, still greater turbulence is created. The resulting "boil" in the pocket 110 functions to effect further separation of lighter specific gravity particulates and correspondingly greater concentration of higher specific gravity particulates in the pocket.

The particulates thus are caused to be classified into a minor, valuable fraction of smaller size and heavier specific gravity particles and a major, tailings fraction of larger size and lighter specific gravity. This classifying action continues as the particulate material moves downward over the upwardly moving stretch of the conveyor belt and laterally, in serpentine manner, along the elongated walls 106 of the pocket members. As the concentrated particles enter the pockets 110, the churning water stirs the particles still further and effects further classification.

For example, if a particle of gold is attached to four parts by weight of clay, the specific gravity of the mass is about 5.7 g/cm$^3$, as compared with the average specific gravity of gold at about 18 g/cm$^3$. Accordingly, this mass must be washed as quickly and as vigorously as possible in order to remove the clay and achieve the high specific gravity to insure collection of the gold particle in one of the pockets 110. The high degree of turbulence achieved as described hereinbefore provides this rapid separation of the clay and gold.

Conditions for classification of diverse materials may be varied by adjusting the angle of inclination of the upwardly moving upper stretch of the conveyor belt 52, the speed of movement of the conveyor belt, and/or the amount of water delivered to the infeed hopper 82. For example, for the separation of gold from river gravel, the inclination of the upper stretch of the conveyor belt 52 is set at about 35 degrees, the belt speed is adjusted to about 25 feet per minute and sufficient water is supplied to form a free flowing slurry. For separation of gold from the clay dirt and rock of desert areas, the belt speed is lowered to about 20 feet per minute and a greater amount of water is required to form a free flowing slurry.

For the separation of the tungsten ore scheelite from the mass of rock and other mine product, wherein scheelite has a specific gravity of 5.9 to 6.1 g/cm$^3$, the inclination of the upper stretch of conveyor belt 52 may be set at the 25 degree angle, indicated in broken lines in FIG. 1, the belt speed may be adjusted to about 15 feet per minute, and enough water is provided to form a free flowing slurry.

As the angle of inclination of the upper stretch of conveyor belt 52 is increased, the pockets 110 collect lesser amounts of the high specific gravity particulates since more particulate material is caused to pass over the pocket members. This results in the recovery in receiver bucket 124 of a smaller but more highly concentrated portion of the total mass of particulate material delivered to the infeed hopper 82.

The foregoing classification process occurs in substantially the same way when using the pocket members 112 of FIGS. 5 and 6. Particulate material carried over or around the pocket members 112 of a preceding upwardly moving row are intercepted by pocket members of a succeeding row of upwardly moving pocket members.

The function of the longitudinally and laterally spaced pocket members 104 and 112 is highly efficient in maximizing classification to a very concentrated fraction of desired particulates delivered by the pockets to the receiver bucket 124. This is due in part by causing the slurry to move in a serpentine pattern laterally across the conveyor belt, by the downwardly and laterally sloping disposition of the elongated walls 106 and rows of small pocket members 112. These arrangements effectively lengthen the travel path of the particulates which thus are intercepted by greater numbers of pocket members.

It has been determined by those skilled in the art of gold panning that within one minute from the time a gold pan of 14 inches diameter is filled with ore and thoroughly agitated and wetted, all free gold particles will have gravitated to somewhere on the bottom of the pan. In the present invention, all of the particulate material has been agitated and wetted before it is deposited on the upper end portion of the upwardly moving upper stretch of the conveyor belt. Accordingly, the gold content of the infeed slurry will be retained in approximately the upper 25 percent of the upwardly moving upper stretch. The gold content thus will be delivered to the receiver bucket 124 in about 10 to 15 seconds.

The highly classified, valuable particulate material collected in the pockets move with the latter over the upper row 54 and thus downward on the lower stretch of the belt. The pockets, having been turned upside down, release their contents which fall by gravity onto the bottom wall 16 of the housing 10. The upwardly directed jets of water from the perforated pipe 146 impinge upon the lower stretch of belt 52 and into the pockets to flush all particulate material therefrom. The particulate material flows down the bottom wall 16 and is directed by the diverter blade 118 into the outlet opening 120 from whence it is delivered through outlet pipe 122 to the receiver bucket 124.

Periodically, the receiver bucket is emptied of concentrate and the tray 164 is emptied of tailings. The water pump 132 also is transferred from one of the containers 30 and 48 to the other for recirculating the water supply to the infeed hopper 82 and to perforated pipe 146.

The classification action is effective to recover substantially the entire content of gold, including fine and microfine particles of gold in the particulate material delivered to the infeed hopper 82. This is achieved by causing the fine and microfine particles to be submerged in the water for interception by the pocket members, rather than being floated on the surface of water flowing to the tailings tray 164, as occurs in conventional placer operations.

For example, with the conveyor belt 52 extending between roll shafts 58 and 60 spaced apart 10.5 feet, and with the centers of longitudinally spaced pockets 110 spaced apart 3 inches, and with the belt moving at a rate of 12 feet per minute, a total of 42 pocket members 104 will be exposed to particulate material on the upwardly moving upper stretch of the belt in 0.875 minute.

With the belt moving at a rate of 20 feet per minute, the total of 42 pocket members 104 will be exposed to particulate material on the belt in 0.525 minute.

Figure 9:
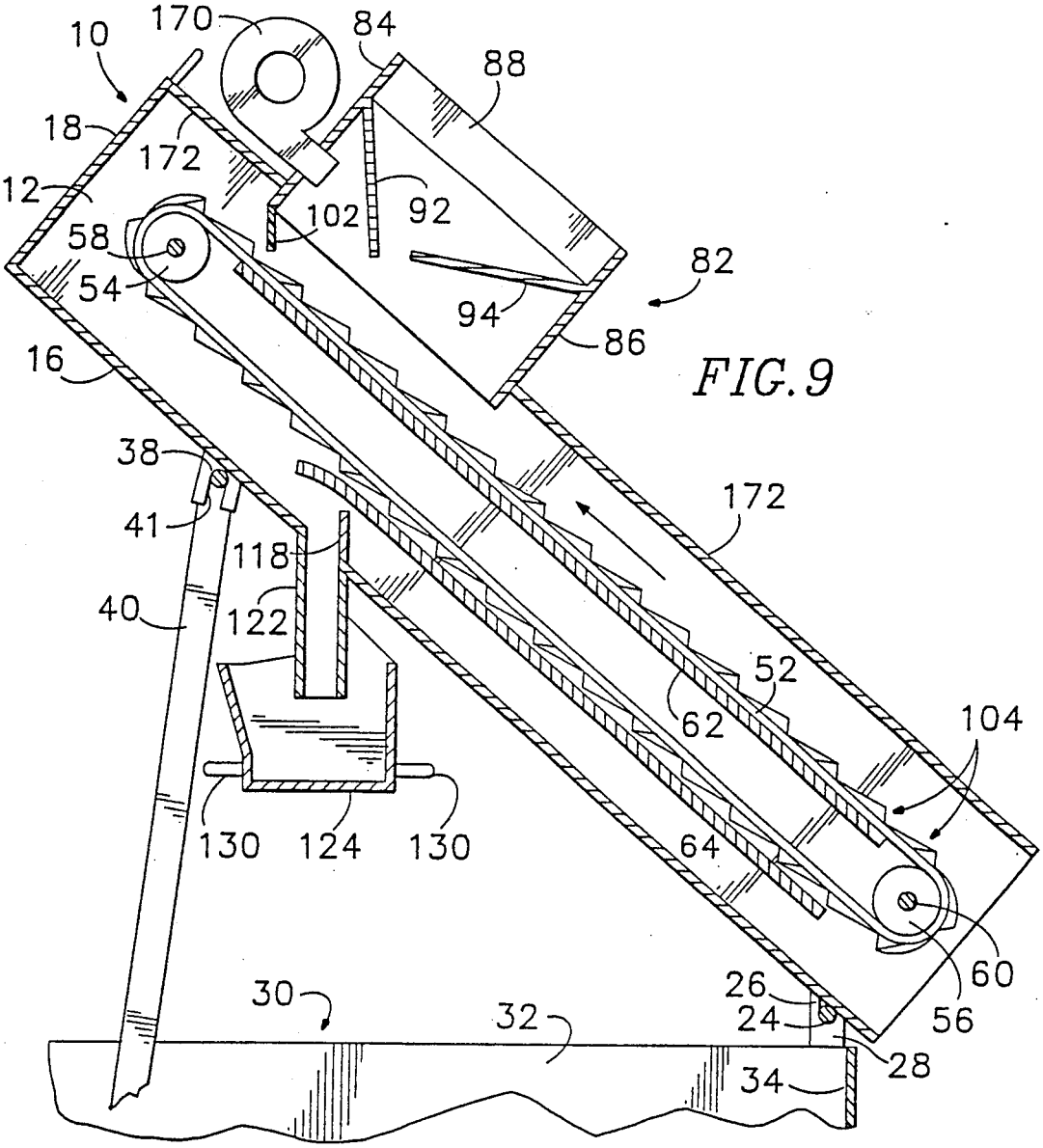
FIG. 9 is a fragmentary vertical sectional view, similar to FIG. 7, showing a modified form of apparatus for processing particulate material in dry condition.
Figure 3:
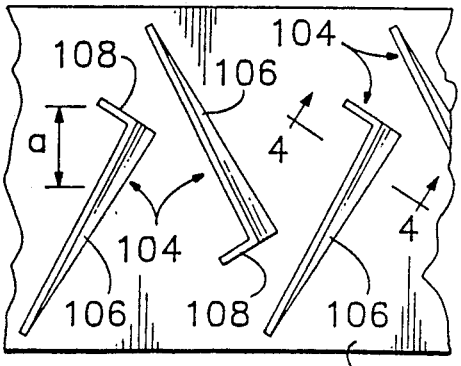
FIG. 3 is a fragmentary enlarged plan view of the conveyor belt of FIG. 2 showing a configuration of the particulate collecting pockets.

The embodiment illustrated in FIG. 9 accommodates processing particulate material in a dry state. For this purpose, there is provided a heater-blower unit 170 arranged to direct heated air downward over the upwardly moving upper stretch of conveyor belt 52. The upper side of the conveyor housing 10 is closed by a cover 172 to confine the heated air to the space immediately above the upper stretch of the conveyor belt. The heated air insures drying of the particulate material deposited upon and moving downward over the upwardly moving upper stretch of the conveyor belt sufficient to insure that no material still clings to the small amount of gold available for recovery.

The operation of the dry processing apparatus of FIG. 9 is analagous to the operation of the water slurry apparatus of FIGS. 1-8. Whereas particulate material carried in a water slurry becomes classified by gravity separation from water, dry particulate material becomes classified by gravity separation from air. In both forms, the smaller size and heavier specific gravity particles are separated by rolling along the conveyor belt, by settling out of a suspension in water or air after the particulate material has been dispersed vertically by cascading water or by bouncing on the belt into the air.

It is a frequent occurrence in gold ore concentration that substantial sizes of gold particles, in nugget form, are contained in the mass of material to be processed. Such large size particles may escape entrapment in the relatively small pockets of the pocket members and thus be transported with the tailings to the tray 164. To insure recovery of such large particles it is preferred that a metal detector 174 be mounted above the tray, as by a support U-shaped bracket 176 supported removably at its opposite ends in sockets 178 secured to the opposite ends of the tray. The metal detector may be of any readily available type, such as Challenger X-100 manufactured by Compass Electronics Corp.

The metal detector may be powered by the same source of electrical potential as is provided for water pump 132, or it may be battery operated. In either case, the metal detector may function, upon the detection of gold or other element desired to be recovered, to deactivate the conveyor belt drive motor 74, or to activate an audible and/or visible alarm, to alert an operator to the presence of valuable material in the tailings on the tray.

The apparatus described hereinbefore is readily provided in various sizes. For example, it may be the small size illustrated for convenient transport on a small truck or large rubber raft for small scale processing operations. It may be made larger for transport on a large trailer for substantially larger scale operation. Water for the slurry type operation may be collected at a convenient source near the processing site. The apparatus also may be provided as a large stationary plant for even larger scale processing operation. In all cases the simplicity of the structural components and assembly contributes beneficially to economical manufacture, maintenance and repair.

It will be apparent to those skilled in the art that various other modifications and changes may be made in the size, shape, type, number and arrangement of parts described hereinbefore. For example, the braces 40 and associated adjustment notches 44 may be replaced with an extensible fluid pressure cylinder or similar device which provides an infinite number of adjustments between minimum and maximum limits. This and other changes may be made, as desired, without departing from the spirit of this invention and the scope of the appended claims.

I claim:

1. The method of concentrating particulate material containing one or more of the elements of the first, second and third transition series in Groups 4b, 5b, 6b, 7b, 8 and 1b of the Periodic Table of the Elements, the method comprising:

(a) providing a substantially impervious endless conveyor inclined at an angle and configured to cause particulate material to flow downwardly over said upwardly moving upper stretch in a manner to effectuate classification of the particulate material by gravity separation, (b) depositing the particulate material adjacent the upper end of the upwardly moving upper stretch of the conveyor, (c) providing on the endless conveyor a plurality of particulate collecting pockets spaced apart across the width and along the length of the conveyor and configured to intercept the downwardly moving particulate material and to collect the particulates of smaller size and higher specific gravity and to allow the particules of larger size and lower specific gravity to exit the lower end of the upwardly moving upper stretch of the conveyor, and (d) discharging the contents of the pockets by gravity as the pockets move downwardly on the lower stretch of the conveyor.

2. The apparatus of claim 1 including adjustable support means engaging the conveyor belt for varying the angle of inclination of the upper stretch of the conveyor belt.

3. The apparatus of claim 1 including power drive means connected to the conveyor belt for moving the latter.

4. The apparatus of claim 3 including control means associated with the power drive means for varying the speed of movement of the conveyor belt.

5. The apparatus of claim 1 including crank means engageable with the conveyor belt for moving the latter manually.

6. The apparatus of claim 1 wherein the infeed means comprises a hopper positioned above the conveyor belt adjacent the upper end of the upper stretch thereof.

7. The apparatus of claim 1 wherein the collecting means includes a receiver bucket positioned below the lower stretch of the conveyor belt.

8. The apparatus of claim 1 wherein each pocket member includes a pair of walls diverging in the direction of movement of the upper stretch of the conveyor belt and forming between them an included angle of less than 180 degrees defining a particulate-collecting pocket.

9. The apparatus of claim 8 wherein the particulate-collecting pocket of each pocket member is less than one-half the width of the conveyor belt.

10. The apparatus of claim 1 wherein each pocket member includes an elongated wall disposed on the conveyor belt to extend angularly across the belt in the downwardly inclined direction of the upper stretch of the belt, a short wall adjoining the lower end of the elongated wall and forming with the latter an include angle of less than 180 degrees defining a particulate-collecting pocket.

11. The apparatus of claim 10 wherein each succeeding pocket member on the conveyor belt is disposed with the elongated wall extending across the belt in the direction opposite the elongated wall of the preceding pocket member, a portion of each elongated wall being on a longitudinal line of the belt in alignment with the pocket of the next preceding pocket member for intercepting particulate material passing over said next preceding pocket member.

12. The apparatus of claim 10 wherein the particulate-collecting pocket of each pocket member is less than one-fourth the width of the conveyor belt.

13. The apparatus of claim 1 wherein each pocket member includes pair of walls of substantially equal length and the plurality of said pocket members are spaced apart across the conveyor belt in a row extending angularly in the downwardly inclined direction of the upper stretch of the belt.

14. The apparatus of claim 13 wherein each succeeding row is disposed in the direction opposite the next preceding row.

15. The apparatus of claim 14 wherein the pocket members of a succeeding row are positioned on longitudinal lines of the belt in alignment with the spaces between adjacent pocket members of the next preceding row.

16. The apparatus of claim 13 wherein the particulate-collecting pocket of each pocket member is less than one-tenth the width of the conveyor belt.

17. The apparatus of claim 1 including means for delivering water to the particulate material at the infeed means for forming a slurry of said material, and means for delivering water to the lower stretch of the conveyor belt for assisting release of particulate material from the pocket members.

18. The apparatus of claim 17 including control means for adjusting the rate of water delivery to the infeed means and lower stretch of the conveyor belt.

19. The apparatus of claim 17 including water container means positioned below the conveyor belt for receiving water returning from the conveyor belt, and water pump means communicating with the water container means for circulating the water therein to the conveyor belt to form said slurry and to assist release of particulate material from the pocket members.

20. The apparatus of claim 19 including a tailings receiver tray overlying a portion of the water container means at the lower end of the conveyor belt for receiving particulate material tailings discharged from the lower end of the belt.

21. The apparatus of claim 19 wherein the water container means includes a pair of containers arranged to fit together to form a substantially closed receptacle for containing the operating components of the apparatus for storage and transport.

22. The apparatus of claim 1 including means for blowing warm air over the particulate material moving downwardly over the upwardly moving upper stretch of the conveyor belt for drying the particulate material.

23. The apparatus of claim 1 including a conveyor belt housing having side and bottom walls, and wherein the collecting means includes an outlet opening in the bottom wall of the housing, and a receiver bucket registering with the outlet opening, and a diverter member is positioned on the bottom wall adjacent the downstream end of the outlet opening for diverting particulate material to said outlet opening.

24. The apparatus of claim 23 wherein the infeed means is a hopper mounted removably on the conveyor belt housing.

25. The apparatus of claim 23 including adjustable support means engaging the conveyor belt housing for varying the angle of inclination of the upper stretch of the conveyor belt.

26. The apparatus of claim 23 including cover means on the upper side of the housing above the conveyor belt, and means for blowing warm air through the space between the cover means and upper stretch of the conveyor belt for drying the particulate material moving downwardly over the upwardly moving upper stretch of the conveyor belt.

* * * * *